United States Patent [19]

Geiger

[11] 4,346,723

[45] Aug. 31, 1982

[54] APPARATUS FOR A WAREWASHER BYPASS SOIL COLLECTOR

[75] Inventor: Paul B. Geiger, Piqua, Ohio

[73] Assignee: Hobart Corporation, Troy, Ohio

[21] Appl. No.: 247,449

[22] Filed: Mar. 25, 1981

[51] Int. Cl.[3] ..... B08B 3/02

[52] U.S. Cl. ..... 134/104; 134/58 D; 134/186

[58] Field of Search ..... 134/58 D, 104, 109, 134/110, 111, 186

[56] References Cited

U.S. PATENT DOCUMENTS

| | | | |
|---|---|---|---|
| 2,629,391 | 2/1953 | Hummel | 134/110 |
| 2,681,658 | 6/1954 | Meeker et al. | 134/111 |
| 2,788,010 | 4/1957 | Glassey et al. | 134/58 D X |
| 2,862,510 | 12/1958 | Geiger et al. | 134/111 |
| 2,879,026 | 3/1959 | Meeker et al. | 251/291 |
| 2,959,179 | 11/1960 | Sasnett et al. | 134/186 |
| 2,961,862 | 11/1960 | Smith | 68/18 |
| 3,064,661 | 11/1962 | Jacobs | 134/58 |
| 3,079,094 | 2/1963 | Brezosky et al. | 241/46 |
| 3,080,742 | 3/1963 | Toma | 68/12 |
| 3,080,874 | 3/1963 | Brucken | 134/115 |
| 3,103,225 | 9/1963 | Schmitt-Matzen | 134/58 |
| 3,179,307 | 4/1965 | Duncan et al. | 222/333 |
| 3,282,427 | 11/1966 | Mandarino et al. | 210/108 |
| 3,310,243 | 3/1967 | Duncan et al. | 241/101 |
| 3,313,311 | 4/1967 | Gilson | 134/109 |
| 3,323,529 | 6/1967 | Geiger et al. | 134/104 |
| 3,356,097 | 12/1967 | Schaap | 134/112 |
| 3,370,598 | 2/1968 | Lopp et al. | 134/111 |
| 3,425,355 | 2/1969 | La Flame et al. | 103/3 |
| 3,549,294 | 12/1970 | Kerr et al. | 134/58 |
| 3,653,807 | 4/1972 | Platt | 8/158 |
| 3,765,430 | 10/1973 | Muller | 134/109 |
| 3,774,418 | 11/1973 | Ohmann | 68/18 F |
| 3,807,419 | 4/1974 | Cushing et al. | 134/104 |
| 3,810,480 | 5/1974 | Smith et al. | 134/104 |
| 3,905,092 | 9/1959 | Abresch | 134/58 D X |
| 3,989,054 | 11/1976 | Mercer | 134/104 |
| 4,038,103 | 7/1977 | Grunewald | 134/10 |
| 4,150,679 | 4/1979 | Cushing et al. | 134/104 |
| 4,150,680 | 4/1979 | Johnson et al. | 134/104 |
| 4,164,430 | 8/1979 | Reinwald et al. | 134/13 |
| 4,168,715 | 9/1979 | Spiegel et al. | 134/104 |
| 4,228,962 | 10/1980 | Dingler et al. | 241/46 R |
| 4,243,431 | 1/1981 | Dingler et al. | 134/104 |

FOREIGN PATENT DOCUMENTS

| | | | |
|---|---|---|---|
| 2556480 | 6/1977 | Fed. Rep. of Germany | 134/104 |

OTHER PUBLICATIONS

"A Dishwasher Designed for Dependability," *Appliance*, May, 1978, p. 44.

Page from a General Electric Dishwasher Service Manual.

*Primary Examiner*—Robert L. Bleutge

*Attorney, Agent, or Firm*—Biebel, French & Nauman

[57] ABSTRACT

A warewasher such as a domestic dishwashing machine has a first recirculating path for recirculating wash and rinse fluids through nozzles which spray the fluid onto food ware items in the wash chamber of the warewasher. Fluid is also circulated from the wash chamber through a soil collecting circuit which conducts fluid to a soil collector where soil is filtered from the fluid before it is returned to the wash chamber. The soil collector quickly removes food soil debris from the fluid on its first passage through the soil collecting circuit and holds it for discharge into the warewasher drain system when the fluids are subsequently drained from the warewasher. A drain pump impeller is used to perform the dual functions of draining liquid from the chamber and recirculating fluid through the soil collecting circuit. In its preferred form, liquid passing through the first recirculating path is preliminarily filtered thereby preventing soil particles from being recirculated and redeposited onto the food ware items. In such preferred form of warewasher, soil removed from the ware can only enter the soil collecting circuit, and by being captured on its initial pass, is prevented from being reduced in particle size, thus minimizing turbidity of the water.

6 Claims, 6 Drawing Figures

APPARATUS FOR A WAREWASHER BYPASS SOIL COLLECTOR

BACKGROUND OF THE INVENTION

The present invention relates to warewashing machines, and more particularly to domestic or household-type dishwashers. Food ware items are cleaned in such machines by a sequence of one or more wash and rinse periods under the control of a timer. During a wash period, water and detergent are introduced into the wash chamber of the warewasher, and this wash fluid is sprayed under pressure onto the food ware items by a reciculating pump which pumps the wash fluid through the nozzles of a rotating wash arm system. At the end of each wash period the soiled wash fluid is drained. For rinsing, clean water alone is introduced into the wash chamber, and this rinse fluid is also recirculated and sprayed onto the food ware items, and then drained. Normally, several rinses are required.

Such machines generally have several different operational modes or "cycles," with the number of wash and rinse periods for each being determined by the soil conditions and the quantities or types of articles typically washed in such a cycle. For example, a dishwasher such a shown in U.S. Pat. No. 3,549,294 (assigned to the assignee of the present invention) enables the machine operator to select any of several wash cycles having different time periods and different numbers of wash and rinse periods. In the '294 machine, a Normal Wash is typically used to clean dishes, glasses, and other dinnerware, while a Soak Cycle is preferably used for removing heavily baked-on encrustations from pots, pans, or casserole dishes which have been used in cooking or baking. While the total quantity of soil removed during any particular cycle is related, of course, to the number of food ware items placed within the warewasher and the extent to which the machine operator may already have scraped food soil from the items before placing them in the warewasher, it is normally expected that more soil will be removed during a Soak Cycle than during a Normal Cycle. As a result, a Soak Cycle will typically include more wash and/or rinse periods than a Normal Cycle.

The need for several wash and rinse periods results from using the same single wash chamber and recirculating and spraying system for both the washing and rinsing phases or the warewashing operation. No matter how well the fluid may be filtered as it is used, some of the food soil debris unavoidably becomes suspended within the fluid and then passes continually through the recirculating pump and spraying system as the fluids are being sprayed onto the food ware items. Many of these food soil particles are then redeposited onto the food ware items as they are being washed and/or rinsed. Some also remain behind on the walls of the wash chamber and within the recirculating pump and spray arms. Multiple rinse periods help reduce this redeposit problem, since, during each rinse period, fresh water is introduced, sprayed, and then drained, so that less and less of this fine soil remains, and less and less is redeposited.

There are two principal methods or theories of washing dishes in a domestic dishwashing machine. In one, the fluid which is sprayed onto the food ware items is first finely filtered of soil, to enable the use of small wash arm orifices (typically as small as 0.157 in. across) and a fairly high pressure pump. Without fine filtering, small orifices and acceptably sized pumps could not be used, and high spray pressures and velocities could not be reliably achieved, due to the likelihood of clogging such small orifices. A small orifice/high pressure system therefore usually requires a fine filter for capturing rather than recirculating the soil. Such a system also typically uses two pumps, one for pumping the filtered fluids through the wash arms, and another, located essentially upstream of the filter, for pumping the water and collected soils to a drain at the end of a wash or rinse period.

In the other method or theory of washing dishes, only a single pump is required for both spraying and draining. There is no fine filter to capture and remove the soil from the recirculating fluid. Instead, the soil is essentially recirculated continuously (except, of course, for the soil particles which are just too large for the pump and spray system to handle. These must eventually be removed manually). The wash arm spray orifices in such a non-filtering system are necessarily much larger (typically 0.276 in.) to permit passage of the larger soil particles without clogging the orifices. Larger quantities of fluid may therefore be pumped, but usually at lower pressures. Since the soil is substantially continuously recirculated along with the fluid, due to the absence of a fine filter in such a system, it is repeatedly subjected to forces which break it up and disintegrate it much more quickly than in systems using a fine filter. This produces a much larger quantity of fine soil particles, which are proportionately more difficult to remove from the food ware items and the warewasher itself, unless a correspondingly larger number of rinse periods is used than is customary in systems employing fine filters.

Even with systems employing a fine filter, however, the recirculating fluid necessarily passes through the debris which has been captured by the filter. In heavy soil conditions, it is possible for the fluid flow to become sufficiently obstructed at the filter, as by partial clogging thereof, to impair the efficiency and effectiveness of the recirculating and spraying system. It is therefore desirable to remove as much of the soil as possible to a remote location separated from the recirculating and spraying system. This not only prevents clogging of the recirculating and spraying system, but also minimizes disintegration and emulsification of the food soil at the filter, caused by turbulence in the fluids, which continuously agitates the collected food soil debris.

The general principle of separate soil removal is widely recognized in a number of other unrelated fields. For example, in many oil-lubricated machines, such as internal combustion engines, in which the lubricating oil is recirculated, a portion thereof is circulated through a bypass filter, thus extending the effective life of the lubricant and of the engine or machine itself. Similarly, in the clothes washing art, an auxiliary water recirculating path is often provided to pass some of the water through a lint filter for subsequent separate removal.

Thus, the more soil which is removed from the primary recirculating and spray system within the warewasher, and the faster it is removed, the fewer wash and/or rinse cycles, and hence the less hot water that will be required. Further, by "extending" the usefulness of the water, early soil separation and removal can reduce the amount of hot water needed in each particular period. As a result, considerable energy and resource savings can be realized both in the quantity of water consumed during each wash or rinse period, and in the total number of periods required.

The prior art relating to domestic dishwashing machines includes several examples of filters intended to function in accordance with the above discussion. However, they are generally only partially effective, or require servicing by the machine operator, or both. Preferably, such a system should remove large as well as small soil particles from the recirculating and spray system as quickly as possible (without first requiring them to pass through the recirculating spray system itself), and should flush them completely down the drain during draining of the fluid from the warewasher, with essentially no intervention or assistance from the machine operator.

SUMMARY OF THE INVENTION

Briefly, the present invention meets the above needs and purposes by providing an inexpensive, highly effective soil collecting circuit and soil collecting method for a warewasher in which wash and rinse fluids are drawn from the bottom of the wash chamber, passed through a soil collector, and the filtered fluid ("supernatant") is returned to the wash chamber.

With regard to the soil collecting circuit, it is independent of the primary spray means within the wash chamber. That is, a typical domestic dishwasher will have one or more spray arms which receive pressurized wash and rinse fluids from the recirculating pump and spray the fluids onto the food ware items within the wash chamber of the dishwasher. In such a machine, the wash arms are the primary spray means since they are responsible for and provide the pressurized fluid spray which impinges on the food ware items to clean and rinse them. Some warewashing machines also include other sprayers or sprinklers to supplement the action of the primary spray means, and these can be distinguished by the fact that the manufacturer would consider the supplementary spray members to be helpful but not essential for satisfactory operation of the dishwasher, while the primary spray means is considered essential and necessary.

In the preferred embodiment, the dishwasher has a circulating system consisting of two pumps: a recirculating pump and a drain pump, and the recirculating pump and primary spray arms can therefore be independent of the drain pump and soil collector. The soil collector is located in a portion of the soil collecting and cleaning circuit which is separated from the wash chamber in order to remove the food soil particles from the wash chamber as quickly as possible, to retain them isolated from the remainder of the wash chamber, and to protect them from the emulsifying and disintegration forces of the wash and rinse fluids within the wash chamber, such as would happen if they were continuously distributed by the primary spray arms. While the soil collector and soil collecting circuit preferably are located beneath the wash chamber such that only the outlet of the soil collecting circuit communicates with the wash chamber, other workable embodiments of the invention may be developed in which the soil collector and/or soil collecting circuit are located within the spaced defined by the wash chamber. Thus, the term "separated" as used herein, with respect to the soil collecting circuit being separated from the wash chamber, merely refers to the soil collector and circuit isolating food soil particles and fluid flowing with them from the remainder of the fluid within the wash chamber, including fluid flowing in the recirculating means.

In the preferred embodiment, the inlet to the soil collecting circuit is at the very bottom of the wash chamber. A dishwashing machine will usually have a sump, and the inlet to the fluid bypass circuit will then be at the bottom of the sump. Since much of the food soil debris which is washed from the food ware items tends to settle to the bottom of the wash chamber, the soil collecting circuit will remove this debris very quickly. In fact, the amount of food soil debris which is removed will usually be greater in proportion to the fluid flowing through the soil collecting circuit, for these very reasons. The bulk of the floating particulate soil which cannot enter the soil collection circuit during the first-fill recirculation will generally be passed directly to drain along with collected soil at the initial drawing.

Another advantage of the independence of the soil collecting circuit from the primary spray means is that the soil collector can accept large pieces of food soil debris, much larger than could be allowed to enter the spray arms, which cannot accept particles larger than the spray orifices therein without risk of the spray nozzles becoming clogged. In contrast, the soil collecting circuit and soil collector can accept food soil debris sizes close to the size of the drain line in the dishwashing machine. Typically, however, a "coarse" filter is provided to prevent very large soil, such as a piece of lettuce which sticks to the bottom of a plate which was stacked before being placed in the dishwasher, from being entrained by the drain pump.

The soil collecting circuit is operable in two modes, a soil collecting mode and a soil discharging mode. In the soil collecting mode the wash or rinse fluids are circulated to the soil collector, which removes the food soil debris from the fluids and collects and holds the debris for subsequent discharge from the warewashing machine. In the soil discharging mode the collected food soil debris is discharged from the soil collector. The soil collecting circuit is operated in the soil discharging mode whenever the drain system of the warewashing machine is draining the wash or rinse fluids out through the drain line. When draining is taking place, the soil collecting circuit discharges the collected food soil debris so that it passes directly out through the drain line. At the other times that the wash and rinse fluids are being recirculated within the warewashing machine, the soil collecting circuit is operated in the soil collecting mode to provide simultaneous and continuous cleaning of the fluids by the soil collector.

In the preferred embodiment, the soil collecting circuit includes a soil collector body or canister having an upwardly open hollow interior which is attached to the underside of the wash chamber bottom. A fine mesh cylindrical screen is mounted between the soil collector body interior and an upward opening into the wash chamber, the screen and the interior of the collector body defining a soil collecting compartment. As will be seen, fluids circulating in the soil collecting circuit are forced to flow through the fine mesh screen, which thus serves as a means to separate the food soil debris from the fluid.

The soil collector body has a fluid inlet conduit and an outlet conduit at the bottom of the hollow interior. When it is time to drain fluid from the warewasher, a normally closed valve in the drain line is opened, and the drain pump discharges through the soil collector directly into the drain line of the warewashing machine, carrying collected soil out the drain, without dispersing it back into the wash chamber. As the food soil debris is being discharged through the drain line, cleaning of the fine mesh screen is facilitated by the flow past the interior of the screen.

The soil collector body is located below the normal static level of the fluid in the wash chamber. Thus, if the machine operator should interrupt operation during the wash or rinse portion of a machine cycle, there will be no movement of fluid into or out of the submerged soil collector body, and the collected food soil debris will remain in the soil collector compartment.

It is to be expected that there will be food soil debris introduced into the warewashing machine that will be too large for the recirculating and spray system, and some which will be too large for the drain pump and soil collecting circuit. Also, the debris which is removed by the soil collector, regardless of its size, will not all be removed at once. Thus, in the preferred embodiment, a relatively fine filter (e.g., openings in the order of 0.045 in. diameter) is provided in the fluid inlet path for the recirculating pump and spray arms. That filter is principally to prevent food soil debris from clogging the water spray jets on the spray arms, and not for the purpose of removing fine food soil for controlling undesirable redeposits. The soil collecting system filter, which may have openings no larger than 0.025 in. in diameter, does not interfere with or obstruct operation of the primary spray system, since the soil collecting circuit bypasses or is independent of the primary spray system.

Although the drain system can accept larger food soil debris particles than the recirculating system, it too has upper limits. The inlet to the drain pump may therefore be provided with a food waste cutter for reducing large-sized food soil debris particles to sizes which can be safely discharged out of the machine through the drain line. Such a cutter or comminuter is shown in U.S. Pat. No. 4,097,307, for example. These particles are then forcibly pumped directly into the soil collector compartment, and trapped therein by the fine mesh screen as described above. The drain pump and cutter are operated continuously while the fluids are being recirculated during washing or rinsing of the food ware items. This provides the cutter with the maximum opportunity to do its job, that of reducing large food soil particles to sizes suitable for passage through the soil collecting circuit. Further, since the cutter is in the fluid circuit upstream of the soil collector, it will pass the food soil particles but a single time to the soil collector. This debris reduction and removal starts immediately and continues throughout the period that the fluids are being sprayed onto the food ware items and the food soil debris is being removed therefrom, thereby providing for more effective soil reduction than in systems where operation of the cutter is effectively limited to short drain periods. The immediate removal of the debris by the soil collecting circuit following the size reduction avoids the excessive disintegration of the debris which would result if the reduced debris were recirculated without filtering. Additionally, in those standard dishwasher designs in which a food waste disposer or drain pump impeller runs continually during operation of the primary spray means, its location at the bottom of the sump causes constant high speed pulverization of the soil, and attendant worsening of the water's condition. This is avoided by fluid movement through the soil collecting circuit in conjunction with the food waste disposer.

Accordingly, the method of the invention is used with a warewashing machine of the type having primary spray arms for recirculating and spraying fluid onto foodware items to remove food soil particles from the food ware items and carry them to a sump at the bottom of the chamber, and a drain system including a pump for pumping fluid from the sump bottom to a drain. The first step consists of pumping fluid, independently of the primary spray means, from the sump through a soil collecting circuit by means of the drain system pump and from these back to the wash chamber. Next, food soil particles suspended in the fluid are removed from the fluid and collected as the fluid circulates through the soil collecting circuit by passing the fluid in the circuit through a fine screen filter in the circuit. Subsequently, the collected food soil particles are discharged through the drain system when the drain pump is operated to drain the fluid from the warewashing machine. In a preferred embodiment, the fluid flow resulting from the discharging step causes simultaneous flushing of the filter.

As may be seen, therefore, the present invention provides numerous advantages. The major benefit is the conservation of water which this invention makes possible. It goes without question that the sooner the water is cleaned at the start, the sooner the food ware items will be clean. It is therefore important to get the soil off the food ware items and out of the wash chamber as fast as possible. For example, a warewashing machine of the type shown hereafter, not equipped with the present invention, would have to fill and drain six times and use approximately 13½ gallons of hot water in a normal wash cycle to clean food ware adequately. When equipped with this soil collecting circuit and operated according to the method disclosed herein, equivalent washing results were obtained with but four fills and eight gallons of hot water, a hot water saving of 41 percent. Recognizing the importance of saving energy and natural resources, it can be seen that the present invention provides substantial and important improvements in the operation of such warewashing machines.

Thus, the present invention provides very effective early soil removal by means which is independent of the primary spray means. The principal aspect of the invention is to separate soil from the recirculating wash or rinse water, collect the soil at a point removed from the main dishwashing operation, and subsequently dispose of the collected soil down a sewer or drain, preferably by pumping it under positive pressure to a sink drain or a food waste disposer connected to the sink drain, and simultaneously cleansing the soil collector for its next use. Soil collection in this manner improves main recirculating pump efficiency and obtains better washing results. Redeposit is substantialy reduced, permitting a substantial reduction in water usage. The captured food soil debris can be disposed of on command (by switching to the soil discharging mode). Thus, disposal of collected food soil debris may be accomplished at the end of each wash or rinse period, when the sump is drained. Or, during an early wash period while soil is being collected in large quantities, soil can be ejected to the sewer in spurts or pulses while draining only a small amount of water from the sump.

As a result of the early soil removal, the present invention enables the washing of dishes, pots, and pans with baked-on soils, etc. under heavy or gross soil conditions, with a smaller number of wash and rinse periods than previously possible. The reduction of the number of wash and rinse periods (and the utilization where possible of a smaller quantity of water for each such period) results in reduced water consumption and inherently, where hot water is involved, a reduction also in the energy which would have been used to heat the water which has been saved. This improvement in washing efficiency, although using less water, is actually accompanied by an improvement in washing effectiveness.

Virtually no moving parts are required in the preferred embodiment, and the invention is self-cleaning without requiring manual assistance. It is also very tolerant of overload conditions. That is, if the soil collecting compartment in the soil collector body should become filled, this will not interfere with operation of the primary spray means. The high pressure washing and rinsing sprays will continue to be provided for cleaning the food ware items within the warewashing machine, and the collected food soil debris will be discharged into the drain line at the end of that particular wash or rinse cycle.

In the preferred embodiment, two separate pumps are used. Dual pump machines provide the additional advantage that the soil collecting circuit does not reduce the fluid volume and pressure flowing through the recirculating pump and spray means. Instead, the drain pump circulates the fluids through the soil collecting circuit. In either case, circulation through the fluid bypass circuit is affirmative, in direct response to the action of a pump, and is much more effective than random or splash methods of debris collection. Flow through the soil collecting circuit is also unaffected or retarded by the high pressure of primary spray arms. The debris which has been collected is readily and quickly disposed of on command when operation is shifted from soil collecting to soil discharging.

While a drain valve is disclosed with the preferred embodiment, the present invention is equally suited for use in warewashing machines having other drainage controls. For example, a valveless drain system having a reversible pump and elevated drain conduit, as shown in U.S. Pat. No. 3,810,480, may be used. In such a system, the soil collector can be located in the drain line at heights below the standing fluid height in the elevated drain conduit. Thus, during a wash or rinse period the reverse rotating the drain impeller would create a pressure head sufficient to conduct fluid through the soil collecting circuit and back to the wash chamber, but not great enough to pass the fluid out through the drain line. During a drain period the drain pump rotation would be reversed, to turn in its forward direction, thereby developing a much greater pressure and pumping the fluid and debris out through the soil collector and drain line.

It is therefore an object of the present invention to provide an improved warewashing machine, such as a domestic dishwasher, having a soil collecting means and method which is independent of the primary spray means to conduct fluid from the wash chamber through a soil collecting circuit which is separated from the wash chamber, to remove, collect, and hold the debris thereat and to return the resulting supernatant to the wash chamber independently of the primary spray means; to provide such a combination in which the soil collecting circuit can be operated in both a soil collecting and soil discharging mode; in which the soil discharging mode causes the collected food soil debris to be discharged through the drain line; in which the removed food soil debris is protected from disintegration and emulsification due to recirculation and spraying of wash and rinse fluids onto the food ware items; in which the food soil debris is removed directly from the wash chamber without first having to pass through or be propelled by the primary spray means; and to provide the above objects and purposes in an inexpensive, versatile, and reliable configuration readily suited for use in a wide variety of warewashing machines.

Other objects and advantages of the invention will be apparent from the following description, the accompanying drawings and the appended claims.

DESCRIPTION OF THE PREFERRED EMBODIMENTS

Figure 1:
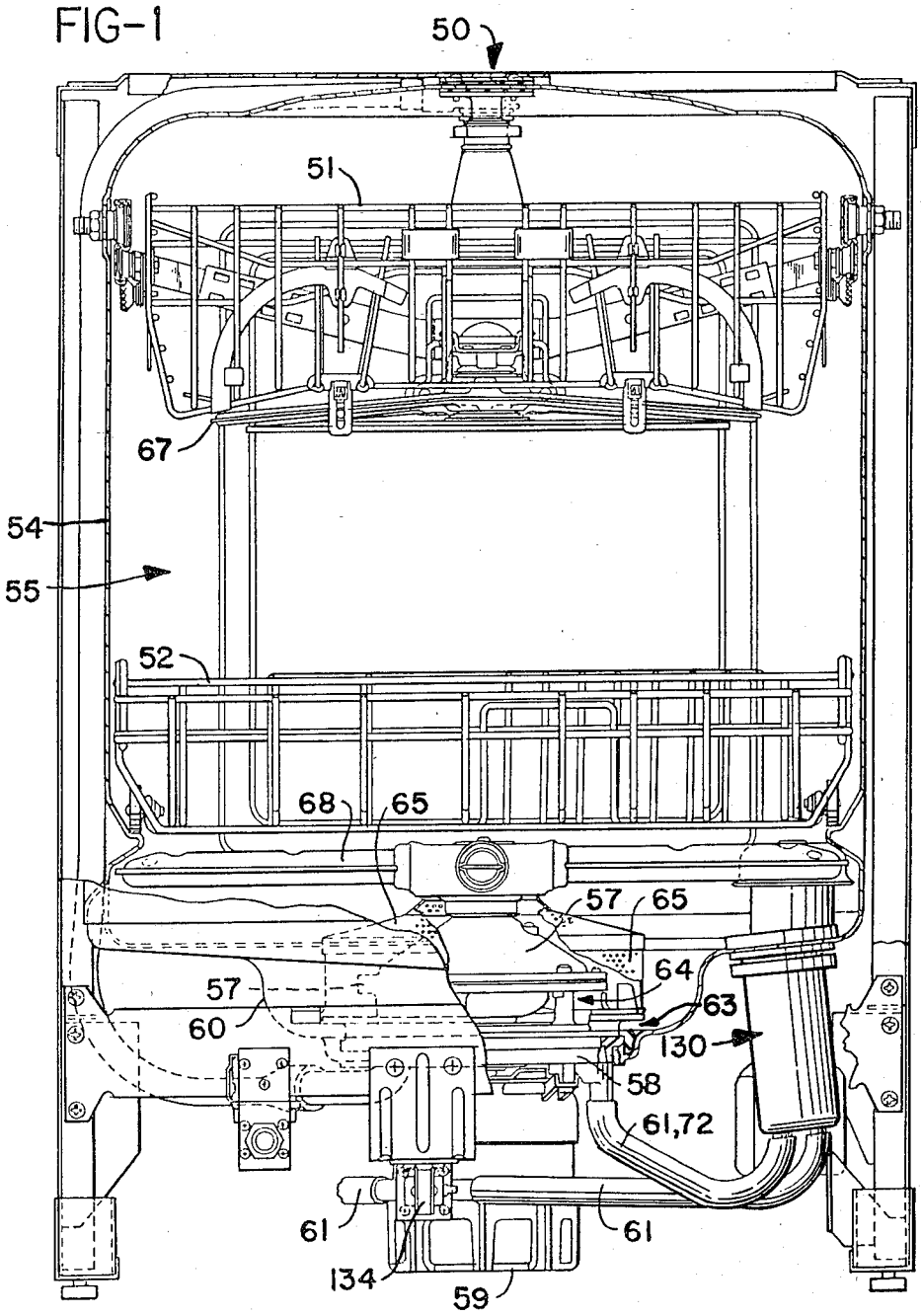
FIG. 1 is a partially broken away cross-sectional view of a domestic dishwashing machine incorporating a soil collector of the present invention.

With reference to the drawings, a warewashing machine 50, such as a domestic dishwasher, includes conventional upper and lower racks 51 and 52 for supporting food ware items, such as cups, saucers, plates, silverware, and so on, within a tank 54. Tank 54 substantially defines the rear, bottom, sides and top of a wash chamber 55 within machine 50 where the washing and rinsing of the food ware items takes place. The front of chamber 55 is defined by a door (not shown) which closes tank 54 during washing and rinsing of the food ware items.

As shown and described in greater detail in U.S. Pat. No. 4,097,307, issued June 27, 1978, assigned to the assignee of the present invention, and incorporated herein by reference, machine 50 also includes a fluid circulating means consisting in part of a recirculating or wash pump 57, drain pump 58, and drive motor 59, mounted coaxially on a common drive shaft which drives the impellers (not shown) of each pump. A sump 60 in the bottom of tank 54 comprises part of wash chamber 55, and the recirculating pump 57 and drain pump 58 are positioned within this sump. Drain pump 58 is part of a drain system which has an opening in the bottom of sump 60 for receiving and draining the wash and rinse fluids from the warewashing machine 50, through a drain line 61, and into a conventional household drain, for example.

In the embodiment shown in FIG. 1, the drain pump inlet 63 is the inlet to the drain system. The recirculating pump inlet 64 is located in sump 60 slightly above the drain pump inlet 63, and is protected by a filter screen 65 to prevent all but the finest food soil debris particles (e.g., smaller than 0.045 in.) from entering the recirculating pump 57 and blocking or clogging the jet spray orifices on the upper and lower wash arm assemblies 67 and 68. Wash arm assemblies 67 and 68 are the primary spray means for cleaning the food ware items within machine 50, and are connected by suitable conduits to the outlet of the recirculating wash pump 57. It will be recognized that the description thus far of machine 50 is of well-known and conventional components usually found in high quality domestic dishwashing machines.

The bypass soil collector 130 is shaped generally like a canister and attached to the bottom of the warewashing machine tank 54 through an opening 132 (FIG. 2) into the wash chamber 55. The collector is located directly in the drain line 61 between the drain pump 58 and a solenoid operated drain valve 134, which operates between open and closed positions. During a wash or rinse cycle the drain valve 134 is closed, but the drain pump 58 remains in operation as long as the recirculating pump 57 and drive motor 59 are operating. This causes fluid to circulate in a soil collecting circuit from the drain pump into the fluid inlet 135 (FIGS. 2 and 3) of the bypass soil collector 130, through a cylindrical screen 139, and then exit through a fluid outlet 136 at the top of collector 130 where it returns to the wash chamber 55. This is referred to as the soil collecting mode.

A debris outlet 137 connects collector 130 to the drain line 61 through the drain valve 134. The interior of collector 130 is hollow and forms a soil debris collecting compartment 138. The filter screen 139 separates compartment 138 from the fluid outlet 136, thus, before the fluid can reach screen 139, it must ascend through an internal extension 142 of fluid inlet 135, and after passing over the internal wall 143 thereof, the fluid and food soil debris descend in compartment 139 toward the debris outlet 137. Screen 139 retains the food soil debris in compartment 138 while permitting the supernatant to return to the wash chamber.

Figure 2:
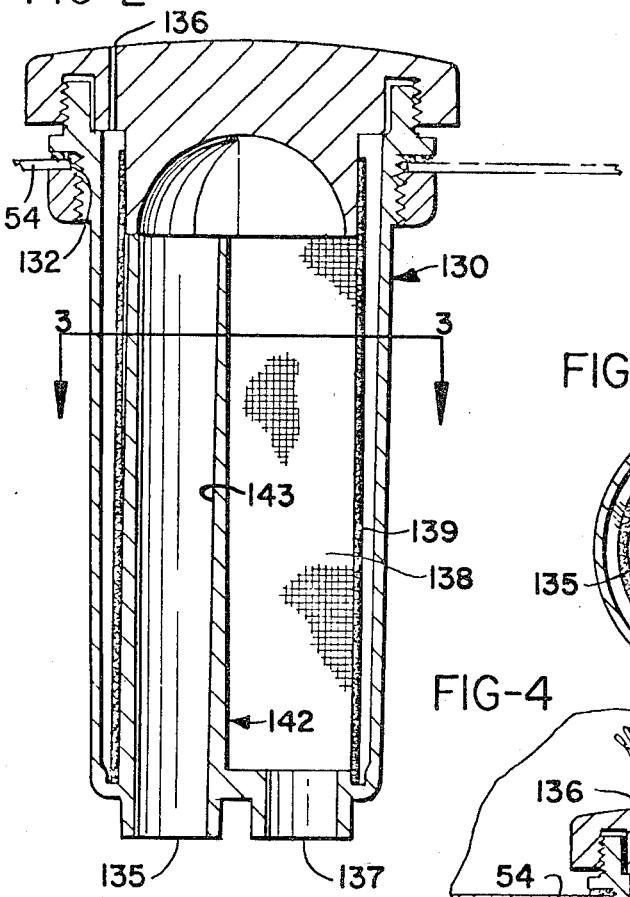
FIG. 2 is a cross-sectional view of the soil collector shown in FIG. 1.
Figure 3:
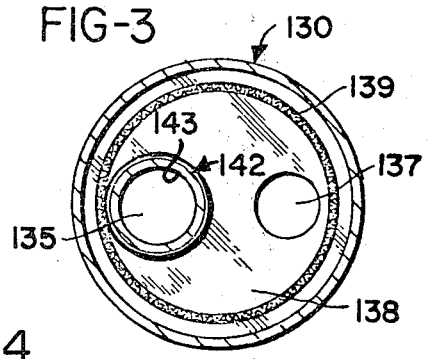
FIG. 3 is a cross-sectional view of the soil collector taken on line 3—3 of FIG. 2.

Thus, as shown in FIGS. 1 and 2, the bypass soil collector 130 forms an integral part of a soil collecting circuit which is independent of the recirculating pump 57 and wash arm assemblies 67 and 68. The soil collecting circuit begins at the drain pump 58 and extends along a conduit 72, which also forms a portion of drain line 61, to fluid inlet 135, through soil collector 130 and fluid outlet 136 to terminate in wash chamber 55.

The bypass soil collector 130 also forms an integral part of a drain system, as shown in FIG. 1. The drain system begins at the drain inlet 63, includes the drain impeller (not shown), and extends through drain line 61 to terminate at a drain.

Figure 4:
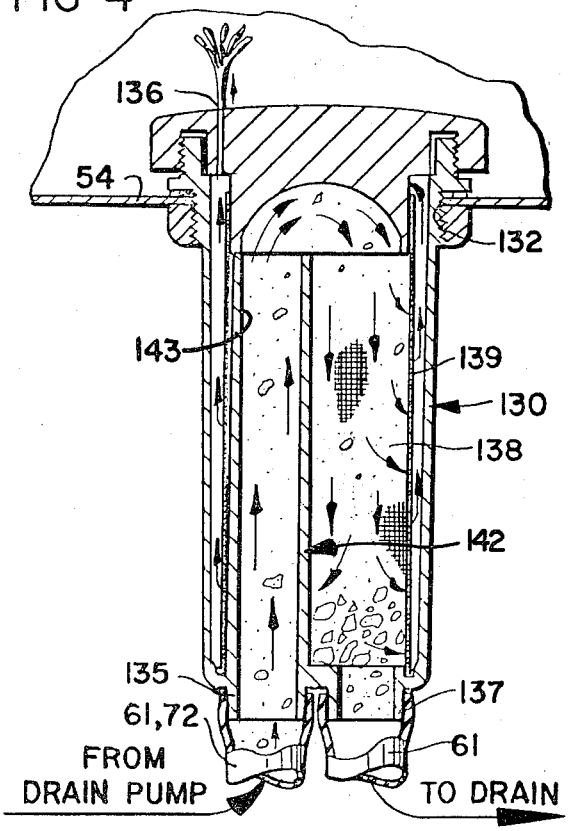
FIG. 4 illustrates movement of fluids through the soil collector.

As may be seen in FIG. 4, the effective cross-sectional flow area of the fluid outlet 136, due to its small diameter, is substantially smaller than that of the internal extension 142 and compartment 138, which connect the fluid inlet 135, fluid outlet 136 and debris outlet 137. As a result, the fluid velocity in compartment 138 is thus substantially reduced in comparison with the velocity in fluid outlet 136, due to its much larger cross-sectional flow area. The substantially reduced net velocity of the fluid as it flows through compartment 138 provides an almost static or quiescent zone in the compartment 138 of the soil collector during the soil collecting mode, and in this zone the velocity of the fluid flowing therethrough is so low that the food soil debris settles to the bottom of the compartment, at the outlet 137. The supernatant which passes through the filter screen 139 returns to the wash chamber compartment through the fluid outlet 136, which is located well above the bottom of the soil collector 130.

When the soil collector 130 is operated in a soil discharging mode, by opening drain valve 134, a large volume high velocity flow of fluid passes through compartment 138 and flushes the collected food soil debris down through the drain line 61. Thus soil collector 130 is actually located directly in the drain line, and compartment 138 is flushed with the fluids being drained from the warewashing machine as they are forced to flow into the fluid inlet 135, through compartment 138, and out through debris outlet 137. As is also clear from FIGS. 3 and 4, the inside of the filter screen 139 is adjacent the flow path of fluid passing from the drain pump through the fluid inlet 135 to the debris outlet 137 during operation in the soil discharging mode. The movement of the fluid therepast aids in removing debris from the interior side of the filter screen and flushing it out through the drain line. Also, by locating the soil collector 130 directly in the drain line itself, the collected food soil debris is forcibly flushed out through the drain line, affirmatively moving the collected food soil debris out of the warewashing machine.

Figure 5:
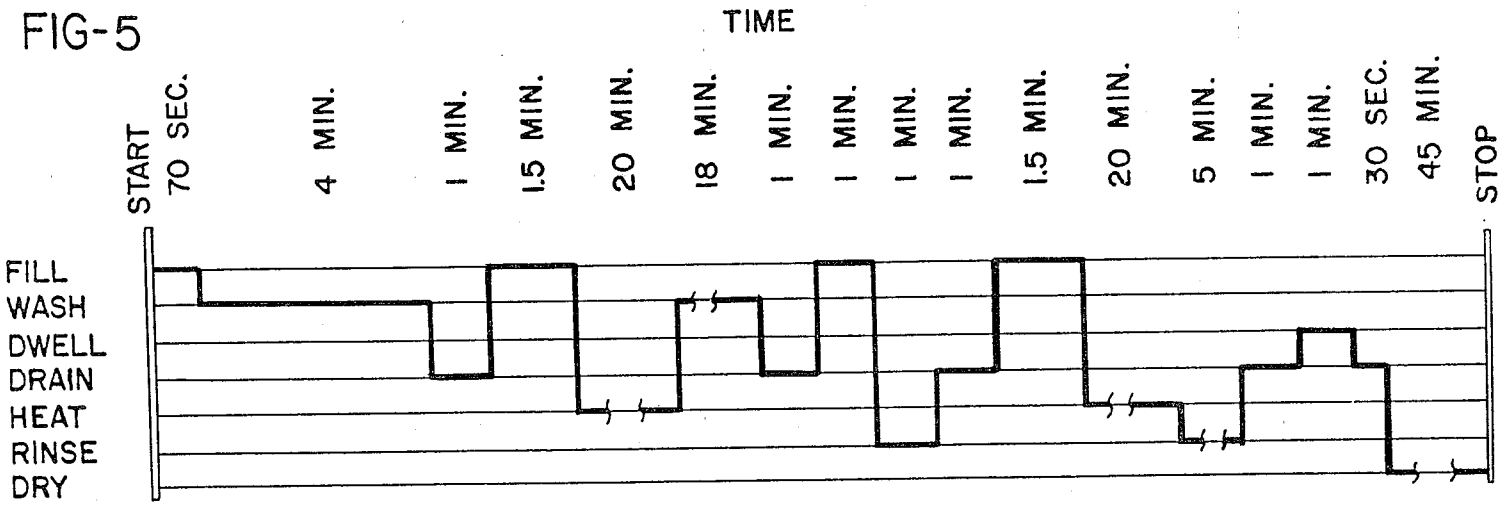
FIG. 5 is a chart illustrating a typical operational sequence or machine cycle for a domestic dishwashing machine incorporating a bypass soil collector according to the present invention.
Figure 6:
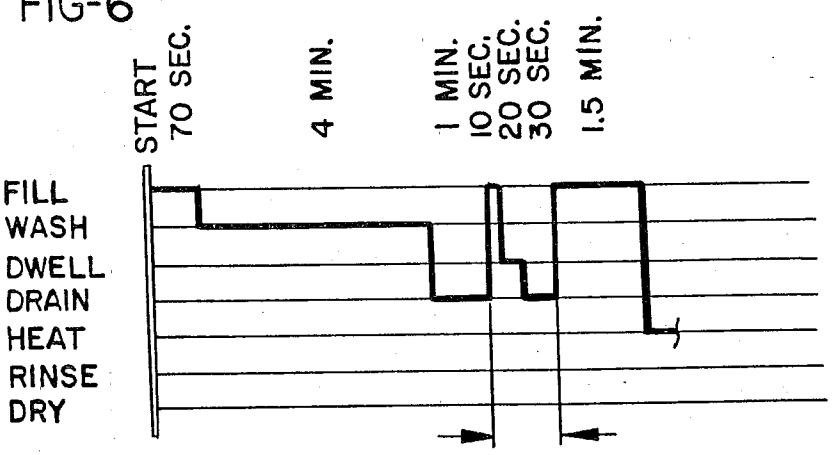
FIG. 6 illustrates a variation on the FIG. 5 cycle.

FIG. 5 illustrates a typical cycle of operations for the warewashing machine. The chart is self-explanatory, showing the sequence and typical times of fill, wash (pump motor on), dwell, drain, heat (heating water), rinse (with fresh water) and dry (statically or with hot air). FIG. 6 is the same type of chart showing a modification of the first several minutes of the cycle of FIG. 5, in which an optional short purge sub-cycle has been added.

While the method herein described, and the form of apparatus for carrying it into effect, constitute preferred embodiments of this invention, it is to be understood that the invention is not limited thereto, and that changes may be made therein without departing from the scope of the invention.

What is claimed is:

1. In a dishwasher which utilizes multiple fluid fills for sequentially washing and rinsing food ware items during a complete cycle, said dishwasher having a wash chamber including rack means for receiving and supporting food ware items therein and a sump at the bottom of said chamber for containing fluid therein; primary spray means including a wash pump operable in a recirculating mode for recirculating and spraying fluid from said sump onto food ware items to remove food soil particles therefrom and carry food soil particles to the sump; a drain system having a drain inlet adjacent the bottom of said sump, a drain outlet communicating with a drain, and a drain pump operable in a draining mode for pumping fluid and food soil particles therein from said sump to a drain at intervals between successive fluid fills; and soil collector means for continuously collecting and removing food soil particles from fluid in said sump while said primary spray means is operating; the improvement comprising:

(a) said soil collector means comprising a soil collecting circuit having an inlet connected to receive fluid from said drain pump, a return outlet located within said wash chamber, and a portion, independent of said primary spray means and said wash chamber, in fluid communication with said inlet and said return outlet;

(b) said portion including a relatively fine screen soil collecting filter in said portion for removing food soil particles from fluid circulating through said soil collecting circuit to be retained within said portion during said recirculating mode, said filter having its upstream side in position to have collected soil particles flushed therefrom toward said drain outlet and into a drain during said draining mode;

and (c) means for selectively controlling said dishwasher to operate said drain pump in either a soil collecting mode by circulating fluid through said soil collecting circuit while said primary spray means is recirculating and spraying fluid onto food ware items or in a drain mode to simultaneously pump fluid and soil particles from said sump during draining.

2. The dishwasher of claim 1 wherein said drain system includes a drain line communicating with said soil collecting circuit and extending from said drain pump to said drain outlet and said selective control means comprises valve means located in said drain line between said drain outlet and said filter, whereby fluid is caused to circulate through said soil collecting circuit when said valve means is closed and caused to pass through said drain system when said valve means is opened.

3. The dishwasher of claim 2 wherein said outlet of said soil collecting circuit includes a fluid flow restriction and wherein said valve means comprises a drain valve operable between open and closed positions, opening of said drain valve enabling fluid under pressure from said drain pump impeller to follow the path of least resistance through said drain system.

4. The dishwasher of claim 2 wherein said drain system is so located with respect to a downstream side of said soil collecting filter that opening of said drain valve causes said drain pump to simultaneously drain fluid and soil and flush said soil collecting filter.

5. The dishwasher of claim 1 including a separate screen filter having a mesh size slightly larger than said soil collecting filter and arranged for filtering food soil particles from fluid entering said wash pump of said primary spray means, the relative mesh size of said soil collecting filter and said separate filter being such that said soil collecting filter traps and collects relatively fine soil particles on their initial pass through said soil collecting circuit, and soil particles passing through said separate filter and thereby being recirculated onto ware being soil particles which have not been entrained in said soil collecting circuit and which are also of a slightly larger particle size capable of passing through said separate filter.

6. The combination of claim 1, 2, 3, 4, or 5 further comprising means forming a compartment in said soil collecting filter in which food soil particles are collected and held, said compartment communicating with said drain system such that it is flushed with at least a portion of fluid from within said wash chamber as collected food soil particles are being discharged from said compartment into said drain system to assist in flushing food soil particles out through said drain system.

* * * * *